US008554608B1

(12) United States Patent
O'Connor

(10) Patent No.: US 8,554,608 B1
(45) Date of Patent: Oct. 8, 2013

(54) DRIVER CONTROLLED AUTOMATED TAXI SERVICE AND DEVICES

(76) Inventor: James O'Connor, Brooklyn, NY (US)

( * ) Notice: Subject to any disclaimer, the term of this patent is extended or adjusted under 35 U.S.C. 154(b) by 330 days.

(21) Appl. No.: 13/069,507

(22) Filed: Mar. 23, 2011

Related U.S. Application Data

(60) Provisional application No. 61/325,314, filed on Apr. 17, 2010.

(51) Int. Cl.
*G06Q 99/00* (2006.01)

(52) U.S. Cl.
USPC ..... 705/13; 705/1.1; 705/7.11

(58) Field of Classification Search
USPC ..... 705/13, 1.1, 7.11
See application file for complete search history.

(56) References Cited

U.S. PATENT DOCUMENTS

| | | | | |
|---|---|---|---|---|
| 5,945,919 | A | 8/1999 | Trask | |
| 5,973,619 | A | 10/1999 | Paredes | |
| 6,204,808 | B1 | 3/2001 | Bloebaum et al. | |
| 6,697,730 | B2 | 2/2004 | Dickerson | |
| 6,756,913 | B1 | 6/2004 | Ayed | |
| 7,181,225 | B1 | 2/2007 | Moton, Jr. et al. | |
| 7,209,757 | B2 | 4/2007 | Naghian et al. | |
| 7,245,925 | B2 | 7/2007 | Zellner | |
| 7,343,243 | B2 | 3/2008 | Smith et al. | |
| 2002/0052751 | A1 | 5/2002 | Ebata | |
| 2002/0095326 | A1 | 7/2002 | Katz | |
| 2002/0184042 | A1 | 12/2002 | Hommrich et al. | |
| 2003/0009360 | A1 * | 1/2003 | Chaudhary et al. | 705/5 |
| 2003/0054837 | A1 | 3/2003 | Ennis | |
| 2004/0036622 | A1 * | 2/2004 | Dukach et al. | 340/691.6 |
| 2004/0093280 | A1 | 5/2004 | Yamaguchi | |
| 2004/0177109 | A1 | 9/2004 | Lee | |
| 2005/0143095 | A1 | 6/2005 | Jacob | |
| 2005/0153707 | A1 * | 7/2005 | Ledyard et al. | 455/456.1 |

(Continued)

FOREIGN PATENT DOCUMENTS

GB 2453829 A * 4/2009

OTHER PUBLICATIONS

Svensson, Bo, A Crossover in Control Design, Mar. 2011, Diesel Progress, 77. 3, p. 126.*

*Primary Examiner* — Akiba Allen
(74) *Attorney, Agent, or Firm* — Michael J. Feigin, Esq.; Feigin & Associates, LLC

(57) ABSTRACT

An embodiment of the disclosed technology is an in-taxi customer selection system. The selection system is placed in a plurality of taxis in the form of a device which includes a touch-screen display map of a surrounding location of each taxi. An indicator of at least one future rider desiring a taxi is exhibited anonymously on each display map. The indicator exhibits only a location, and thus, lacks destination data or information about the potential rider other than his or her location of pickup. In this manner, all picked up riders are anonymous to the driver and discrimination against the rider is actually less than in the prior art, since the appearance of the rider cannot be judged before the ride is accepted. Sensors within the touch-screen display receive a selection of an indicator on one of the display maps from a driver of one of the taxis using this system. The selected indicator is then removed from all other display maps, if shown on any at the time, and the driver is sent a confirmation of said selection. In this manner, only drivers actively looking for rides see who is looking, and such drivers only see riders who are waiting for a taxi ride.

20 Claims, 5 Drawing Sheets

(56) References Cited

U.S. PATENT DOCUMENTS

| | | | | |
|---|---|---|---|---|
| 2005/0227620 | A1 | 10/2005 | Morimoto | |
| 2006/0034201 | A1 | 2/2006 | Umeda et al. | |
| 2006/0059023 | A1 | 3/2006 | Mashinsky | |
| 2006/0135134 | A1 | 6/2006 | Mezhvinsky et al. | |
| 2006/0136254 | A1 | 6/2006 | Greenstein | |
| 2006/0155429 | A1* | 7/2006 | Boone et al. | 701/1 |
| 2006/0217885 | A1 | 9/2006 | Crady et al. | |
| 2008/0014908 | A1 | 1/2008 | Vasant | |
| 2008/0015923 | A1 | 1/2008 | Masaba | |
| 2008/0294556 | A1* | 11/2008 | Anderson | 705/44 |
| 2009/0192851 | A1 | 7/2009 | Bishop | |
| 2009/0326991 | A1* | 12/2009 | Wei et al. | 705/5 |

* cited by examiner

DRIVER CONTROLLED AUTOMATED TAXI SERVICE AND DEVICES

BACKGROUND OF THE DISCLOSED TECHNOLOGY

The combination of global navigation systems and handheld device communications has allowed a new generation of tools involving geo-location and wireless communication to be introduced. It is now possible to use a cellular phone to select which taxi you would like to hail, and for the driver of such a taxi to receive your signal within the cabin of the vehicle and then pick you up, such as in U.S. Patent Publication US 2009/0192851 to Bishop. However, such prior art solutions leave room for improvement.

More particularly, such systems typically require a change in customer behavior. However, the process of hailing a cab for the purpose of receiving a ride has been in place for decades and is understood worldwide. One can stand on a street corner in London, Amsterdam, Jerusalem, or New York and stick his hand out to hail a cab. The use of electronic devices, allowing a person to pick a certain cab and hail it via a communications network often is less efficient, not more so. Now, the cab may pass up three potential rides in order to pick up a person who hailed it from blocks away. Such systems also may create unfair advantages for some customers, compared to others, and thus, are forbidden by various taxi and limousine commissions. Cab drivers, in many cities, are not allowed to "skip over" or turn away anyone.

Thus, as seen by the prior art, there is a desire to use technology, such as handheld wireless devices, to propel the state of the art forward and make hailing a cab easier; but what is needed is a way to do so which allows drivers to observe anti-discriminatory regulations while increasing efficiency of the taxi system, so that cab and limousine companies will be enticed to use such systems.

SUMMARY OF EMBODIMENTS OF THE DISCLOSED TECHNOLOGY

An object of the disclosed technology is to allow prospective riders of taxis and limousines to seek out such rides by usage of handheld wireless devices, telephones, and forms on websites.

A further object is to allow drivers to retain control over which riders they accept in a non-discriminatory manner.

Another object is to provide technology in a cab or limousine to select a rider for pickup.

An embodiment of the disclosed technology is an in-taxi customer selection system. The selection system is placed in a plurality of taxis in the form of a device which includes a touch-screen display map of a surrounding location of each taxi. An indicator of at least one future rider in need of a taxi is exhibited anonymously (from the perspective of the taxi driver him or herself) on each display map. The indicator exhibits only a location, and thus lacks destination data or information about the potential rider other than his or her location of pickup. In this manner, all picked up riders are anonymous to the driver, and discrimination against the rider is actually less than in the prior art, since the appearance of the rider cannot be judged before the ride is accepted. Sensors within the touch-screen display receive a selection of an indicator on one of the display maps from a driver of one of the taxis using this system. The selected indicator is then removed from all other display maps, if shown on any at the time, and the driver is sent a confirmation of said selection. In this manner, only drivers actively looking for passengers see who is looking, and such drivers only see potential riders who are waiting for a taxi.

On any given display map in a taxi, there may be a plurality of indicators, each of at least one potential passenger desiring a taxi. All indicators depicted may be identical. In embodiments of the disclosed technology, at least one potential passenger may be notified that a taxi is coming to pick him/her up, as a result of a sensor within said touch-screen display detecting a selection of an indicator representative of the future rider.

Once the taxi picks up the "future rider," the "future rider" is now called a "rider" and, in embodiments, a second detection of a selection made by the driver is determined, indicating that the rider is in the taxi. The driver may be given instructions to proceed only if the first selected indicator represented a location at which the taxi is currently positioned. That is, the taxi driver may only proceed if he has picked up the rider corresponding to the indicator he selected, as determined, at least partially, by comparing the taxi's location to that of the location on the map of the selected indicator. The taxi's location may be determined by data from a global positioning system satellite. Further verification data required before proceeding may include receiving data from the rider entered into a device comprising said display map. This might be data received via near field communication, last four digits of a credit card number, or a confirmation code given to the rider and verified by providing it to the driver. In this manner, it is ensured that the correct passenger is in the correct taxi, and, if the rider provided billing information before entering the taxi, that the correct rider is being billed.

Route, fare, and time data may be provided to the rider via an electronic interface after a ride is complete. This may be via an interface on a website, a print out, or the like.

In a method of embodiments of the disclosed technology, a rider is picked up for a taxi ride. The method is carried out by way of engaging a global positioning system to determine location, viewing a street map showing the location, and viewing a plurality of indicators on the street map, each indicator anonymously representative of a person desiring to be a rider in a taxi, and disappearing upon an indicator being selected by another taxi. Once an indicator is selected, the driver drives to a location represented by the selected indicator on the street map and picks up the rider. The driver, or a device under the operative control of the driver, receives data from the rider indicating that the rider is a person represented by the selected indicator. Upon the selection of a rider/indicator being made, other indicators are no longer displayed on the street map. In this manner, the rider may require no special equipment and may request a taxi simply by calling a taxi company in the way to which he is accustomed. The method is carried out by the driver.

In another embodiment, a device in a first taxi has satellite navigation capabilities, a display showing a map image of an area surrounding that of a present location (determined by way of the satellite navigation capabilities), and a bi-directional wireless communication configured to receive location data corresponding to locations of people desiring rides. Received data related to people desiring rides consists only of location data. An interface is also provided, capable of providing interaction capabilities with indicators overlaid on the map image, each indicator of the indicators placed on the map corresponding to a location of a person desiring a ride. Upon selection of an indicator by way of the interface, non-selected indicators are removed from the display.

A second device with each of the elements of the first device (satellite navigation capabilities, display, bi-directional wireless communication, interface) is also disclosed, this second device being in a second taxi. Upon selection of an indicator in the first taxi, the selected indicator is removed from the display of the second taxi.

After selection of the indicator, via the bidirectional wireless communication, identifying information of a person receiving a ride is received and exhibited on the display to a driver of the (first) taxi. Such information may include identifying information to ensure the correct rider is picked up. The device may authorize the driver to charge the rider only if a current location detected via the satellite navigation capabilities is the location overlaid on the map corresponding to the selected indicator. The device may further have a credit card reader, for use after the authorizations have been met.

Embodiments of the disclosed technology are described in more detail, below.

DETAILED DESCRIPTION OF EMBODIMENTS OF THE DISCLOSED TECHNOLOGY

The presently disclosed technology simplifies the process for a person seeking a ride, while retaining control over pick-ups by the taxi drivers. The technology also meets guidelines set out by taxi and limousine commissions. The present technology allows for the least amount of change to the typical habits of taxi hailers and taxi drivers.

In embodiments of the disclosed technology, a customer selection system is provided in a plurality of taxis. A taxi hailer, hereinafter, "rider," indicates that he or she would like to be picked up by a taxi. A taxi, as defined in this disclosure, is any vehicle which picks up a rider or riders (one or more persons) who desire a ride in the vehicle to a destination for a fee. A taxi driver, hereinafter "driver," receives geo-location information on a screen within the taxi indicating a location of the rider. Such geo-location information may be in the form of latitude and longitude coordinates, and address, or a cross-street, and is represented by a dot or other indicator on a map showing the area surrounding the taxi and driver. When a driver selects a rider, the dot or other indicator disappears from the screens of other drivers. As such, the actual selection of who will be picked up (which rider enters which taxi) is made by a driver, and a rider needs to expend less effort than is required in the prior art.

In embodiments of the disclosed technology, dots or indicators may also be shown on the screen/display indicating the location of other taxis. This or these indicators appear different than that of indicators representing people desiring rides. Thus, for example, a driver may choose to take a rider not near other taxis in order to ensure the rider has not entered another taxi before he or she is on scene. Or, the location of many taxis will indicate to the driver a place where he or she is likely to pick up a fare as other taxis are gathered there. This is especially useful for a driver who is unfamiliar with or new to the area as a taxi driver.

Figure 1:
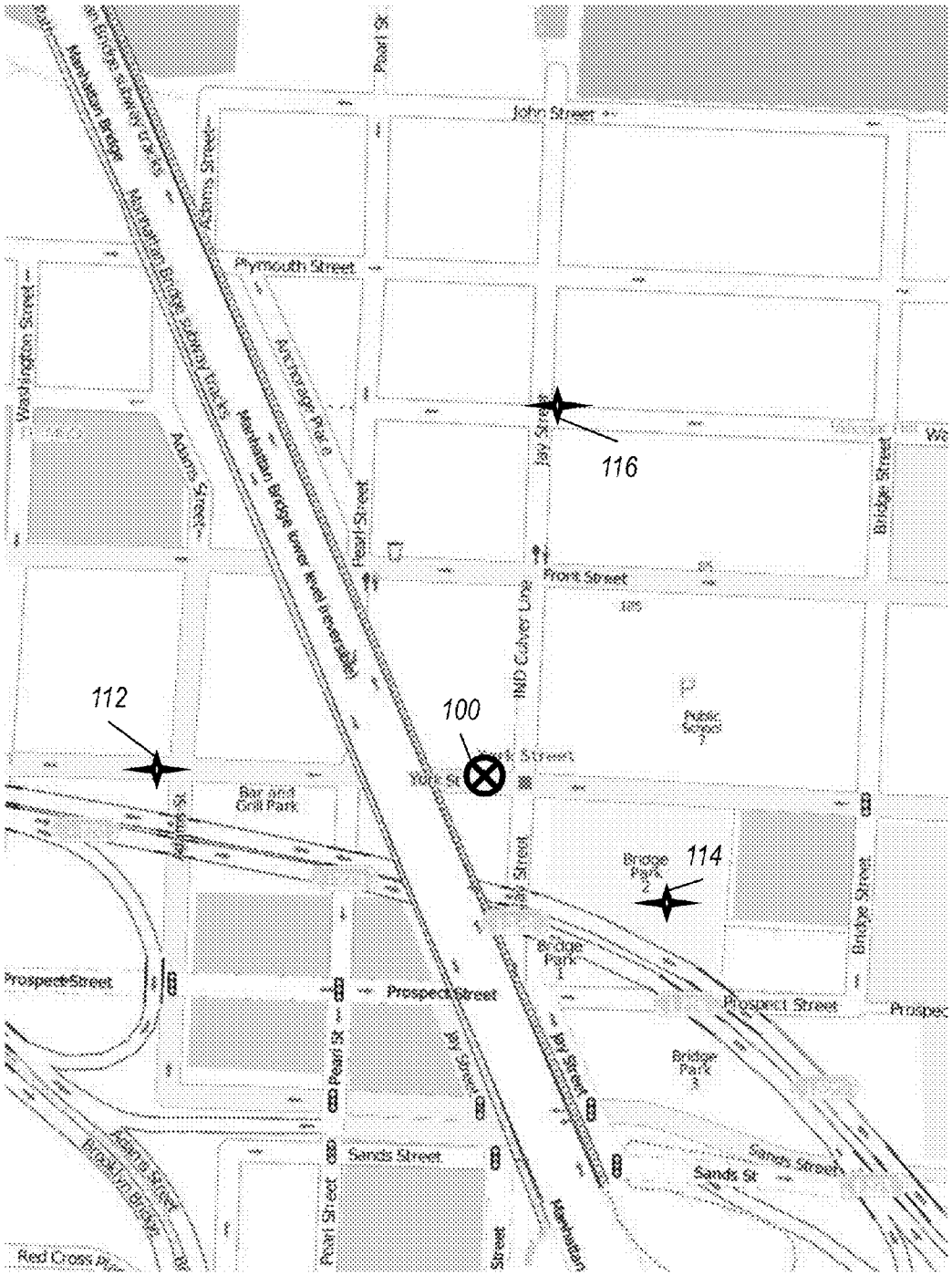
FIG. 1 shows an example of a console screen used by a driver in an embodiment of the disclosed technology.

FIG. 1 shows an example of a console screen used by a driver in an embodiment of the disclosed technology. The taxi is located at position 100, generally at the center of the screen, and potential riders are located at positions 112, 114, and 116. These potential riders have indicated to a dispatcher, central server run, for example, by a taxi and limousine commission, or taxi company, their desire to be picked up by a taxi. On consoles such as touch-screens within each of a plurality of taxis, such potential riders are shown. In an embodiment of the disclosed technology, the riders are shown anonymously. The only information presented to the driver, or in some embodiments, sent to the console, is location information of a person desiring a taxi ride. Destination information or other identifying information is left out. That is, in such embodiments, the packet of information sent to the driver or console thereof, or shown on the console, is limited to, consists of, or only contains location data. In embodiments of the disclosed technology, such information sent or shown also consists of indicating that the client presently wants to be picked up, e.g., by showing an indicator, which may be in a specific color. In this manner, regulations, such as those prohibiting a driver from discriminating based on length of the trip or class of the person, are followed, with the only factor in the decision to choose a potential rider being the location of pickup.

Figure 2:
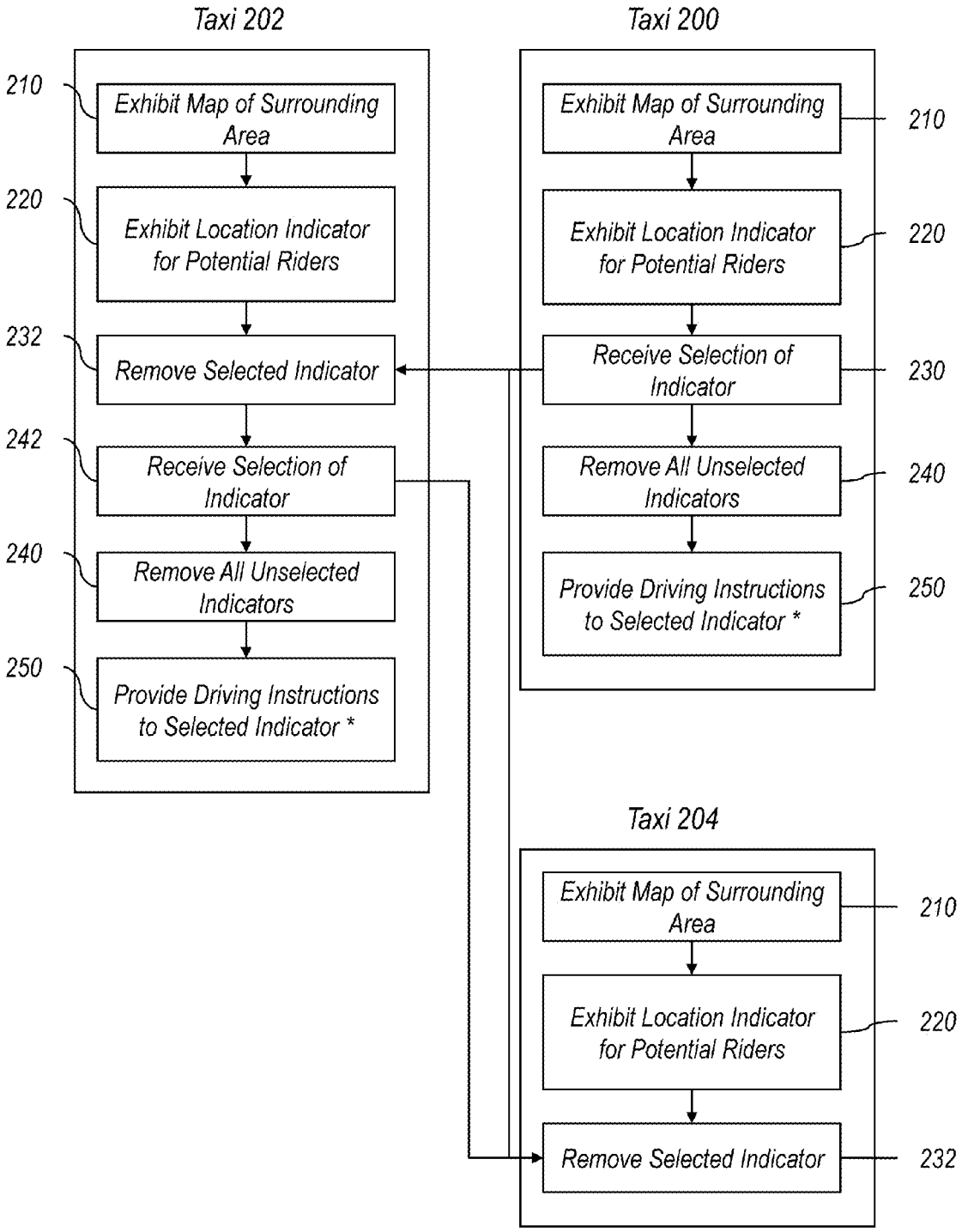
FIG. 2 shows a high level diagram of steps carried out on consoles within taxis in embodiments of the disclosed technology.

FIG. 2 shows a high level diagram of steps carried out on consoles within taxis in embodiments of the disclosed technology. It should be understood that taxis 200, 202, and 204 are by way of example. Any number of taxis may be used. Taxis 200, 202, and 204 are, in this example, in the same geographic area, though, again, this disclosed technology may be used while taxis overlap in a given geographic area and when in separate geographic areas. The map size shown in each taxi may be pre-defined, such as within a quarter mile, half mile, or one mile radius, or may be adjusted by the driver. A maximum number of indicators of positions of potential riders may be shown, and a maximum distance away may be shown for privacy and/or security purposes. Further, in this regard, a driver is aware only of locations of people who want to be picked up, and he receives no further information. In some embodiments, such as where many riders want to be picked up in a designated area, in one taxi, certain riders are shown, while in another taxi other riders are shown. The longest waiting rider may be shown in a given geographic area, such as within a city block or at a venue such as a stadium, public transportation hub, or theater.

In each of the three taxis, 200, 202, and 204, a map is exhibited of the surrounding area in step 210. That is, the map is of the surrounding area for each respective taxi. Then, in each of the three taxis, a location indicator is indicated for potential riders in step 220. A potential rider provides this information by way of a handheld wireless device, web interface, phone interface, via a regular phone call, or by pressing a button at a certain location or letting a dispatcher at a taxi stand know that he or she desires a taxi ride. Such a location with a button or dispatcher may be a high traffic area which taxis frequent, such as a bus terminal, train station, or airport. Upon pressing a button, verification information may be given, such as a ticket number to be presented to the taxi cab to ensure rides are given in proper order and to alleviate the need for lines (queues). Similarly, such information may be transmitted via near field communication to a person's handheld wireless device, which is then transmitted from the wireless device to a console or device within the taxi to verify that the correct rider enters the correct taxi. So, too, the rider may enter his billing information at a taxi stand, while waiting for a taxi to arrive, via a handheld wireless device, or via a web interface anytime before receiving the taxi ride, such as when he has created an account with the taxi company or taxi commission.

In another example, a handheld wireless device may be equipped with a geo-location device (cellular, satellite navigation based, or a combination thereof) or may allow the potential rider to input his present address or position. Similarly, a potential rider may indicate his location via a phone interface (e.g., speaking to a dispatcher or operator) or web interface. These data are uploaded to a central server, such as a server operated by or under the control of a taxi cab company, a taxi commission, government agency, or the like, to aggregate such data. This information is then represented, in step 220, as indicators on a map (see FIG. 1). As should be understood, only those indicators which are within the vicinity of (a defined distance from) an individual taxi 200, 202, or 204 are shown on the respective map.

Referring still to FIG. 2, in step 230, a driver of taxi 200 selects an indicator, thus indicating that he or she will pick up the person at the location of the indicator. The selection is received by the console in the taxi 200. At this time, the indicator in taxi 200 may change color, more information may be provided about the pickup location (e.g., name of venue, etc.) and simultaneously (defined as, as soon thereafter as can be processed), all unselected indicators are removed from the console in taxi 200 (in step 240), as the driver of taxi 200 has no further need to know about other fares. In an optional step 250, driving instructions to the selected indicator may be provided, e.g., navigation instructions.

Simultaneously or after receiving a selection of an indicator in step 230 from the driver of taxi 200, the selected indicator is removed from taxis 202 and 204, as shown in step 232. Taxis other than the taxi picking up the rider associated with the selected indicator have no further need to track this rider, and, in fact, continuing to show the rider might lead to confusion and potential misuse.

Though not shown in the figures, the (potential) rider, through his or her handheld device, through a phone system (automated or dispatcher), or in any other manner, is informed, in embodiments of the disclosed technology, that a taxi will approach to pick him or her up. This is in response to the hailing of the taxi. At any time, a rider may select a "cancel fare" button, notify a dispatcher of a cancellation, and so forth, and the selection is then undone or removed, and the process starts anew from step 210. After a certain number of no-shows, cancelled calls, and the like for a particular rider, his account may be terminated, charged a fee, or warned of same. If the rider does get into the car, software used by the rider to hail the cab may further include a fare calculator which takes into account time of day, city vs. rural, tolls, rates for driving to airports and the like, so that an estimate can be made by the rider to ensure proper billing, or billing within a reasonable range (e.g., estimated within 15% of the actual rate) of the cab driver's bill. The actual bill, as it accrues, and other ride information, may be displayed on the person's wireless device, or received via a cellular or near field communication data stream. Such data may also be provided or viewable afterwards via a web interface, printout, or the like.

The process of selection and removal, in the example of FIG. 2, is repeated, wherein taxi 202 now selects an indicator associated with a (different) potential rider in step 242, and taxi 202 becomes "married to" the rider selected. The process then continues in taxi 202, whereby all unselected indicators are removed in step 240, and driving instructions, etc. may be provided in step 250. Likewise, the selected indicator is removed from the console of taxi 204 (and other taxis) as step 232 is carried out on the console in taxi 204.

In embodiments of the disclosed technology, other cabs using the system may also be displayed on a map in a console. This may help the cab driver to decide whether or not to select a potential rider through a console, as the rider may simply decide to take another cab passing by. Additionally, a cab driver may use this information to decide to go to a certain area or avoid a certain area, e.g., if there are too many cabs in an area already, a cab driver may choose to drive in another direction. Even if the other cabs aren't actively using the console, this information is still helpful to other cab drivers. Information on a console may also be color-coded in embodiments of the disclosed technology. For example, the cab in which the console is located might be black, other cabs in green, a red dot for potential riders, and a green dot for a selected rider. A selected rider or other element may flash, to indicate which rider has been chosen.

On a backend, which is a system that aggregates information about riders wishing to receive rides in a taxi and/or propagating data to consoles within taxis, cab location data may further be tracked, records and statistics may be kept, information may be communicated to third parties (e.g., a taxi and limousine commission), and accounts may be setup with individual users desiring to seek taxis in the future. In this manner, a user may be automatically billed for each taxi ride taken, thereby ensuring accuracy based on starting and ending location of the taxi, time of day data, and city/rural routes taken. Further, the pickups and drop-offs become more seamless as riders need not pay the driver before exiting and the number of non-paying riders decreases. A credit card machine or the like might also be provided for use by the passenger at the beginning of the trip and charged when the trip ends.

Figure 3:
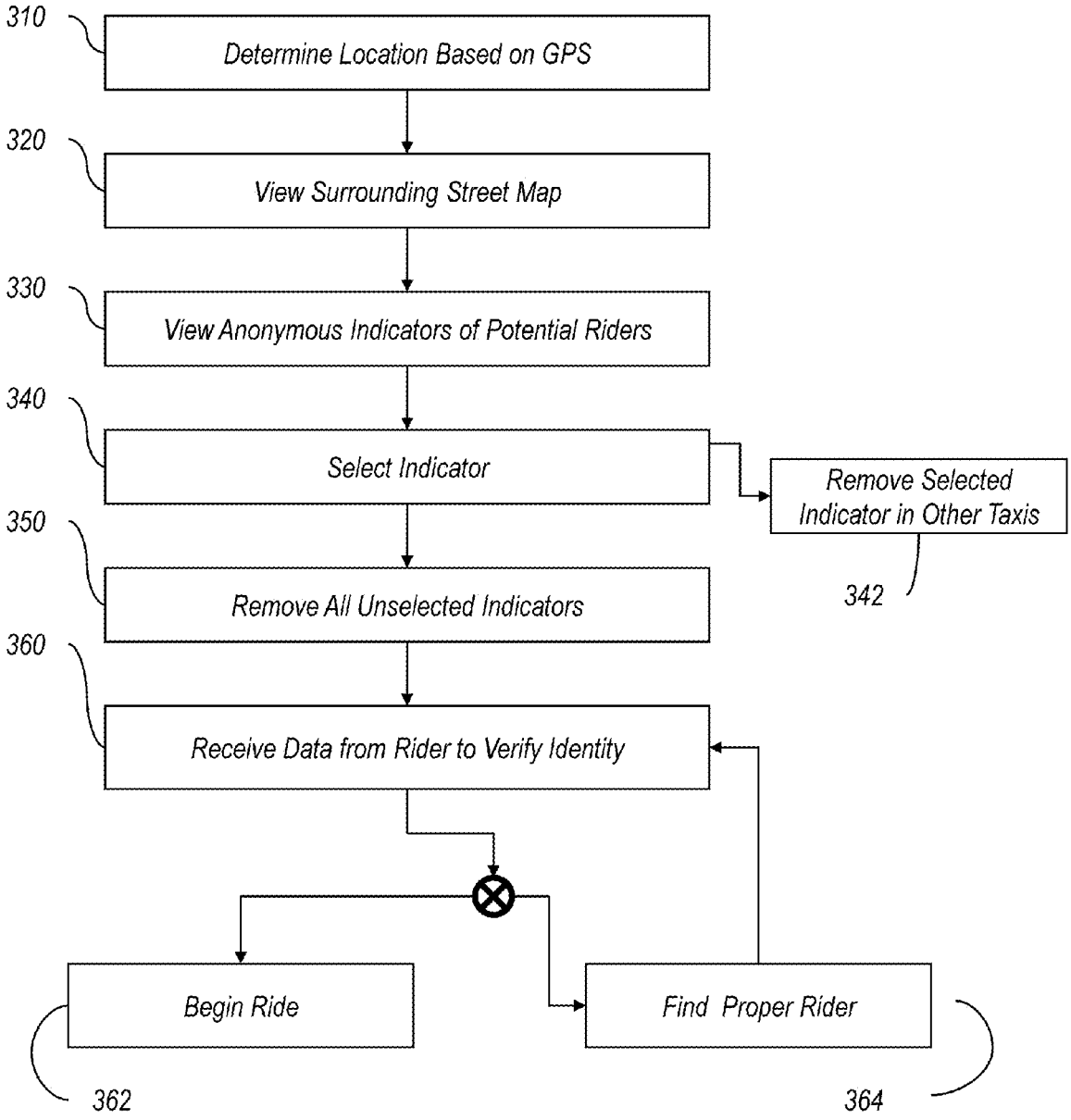
FIG. 3 shows steps carried out by a taxi driver in embodiments of the disclosed technology.

FIG. 3 shows steps carried out by a taxi driver in embodiments of the disclosed technology. In step 310, location is determined based on engaging a GPS (global positioning system) device. Once the location is determined, in step 320, the driver views the surrounding street map with, in step 330, anonymous indicators of potential riders. In step 340, the taxi driver selects an indicator, by, for example, typing the number associated with an indicator (e.g., the closest nine people available for pickup are shown and numbered 1-9), a colored dot, or the like. Once selected, in step 342, the indicator is removed from other taxis utilizing this system, and in step 350, the unselected indicators are removed from the display in the selecting taxi.

Information is then received from the rider, in step 360, to verify his or her identity. This information may be as simple as the rider (here, still a "potential rider") flagging down a cab, such as a cab with a certain color light indicating that the cab is headed to pick someone up, and the rider saying, "Hi, I called a cab to this location!" This, of course, works only at uncrowded locations such as a residential street address. The rider may verify that the taxi driver is at the correct location. In more dense areas, such as on a city street, the information may include a confirmation code, data transmitted electronically, or the like. If it turns out, in step 364, while trying to find the rider, that the found person is the wrong person (e.g., wrong street address, wrong confirmation code, etc.), then the taxi driver keeps scanning the location and step 360 is repeated. This may be in the form of, "Who here has ticket number 45? You're next!" Then, the person holding this ticket steps up, or the person with this confirmation on his handheld wireless device exhibits same or transmits same. Once the rider is authenticated, in step 362, the ride begins. Until the authentication is completed, the taxi driver may be prevented from beginning the ride/beginning to bill the rider.

Figure 4:
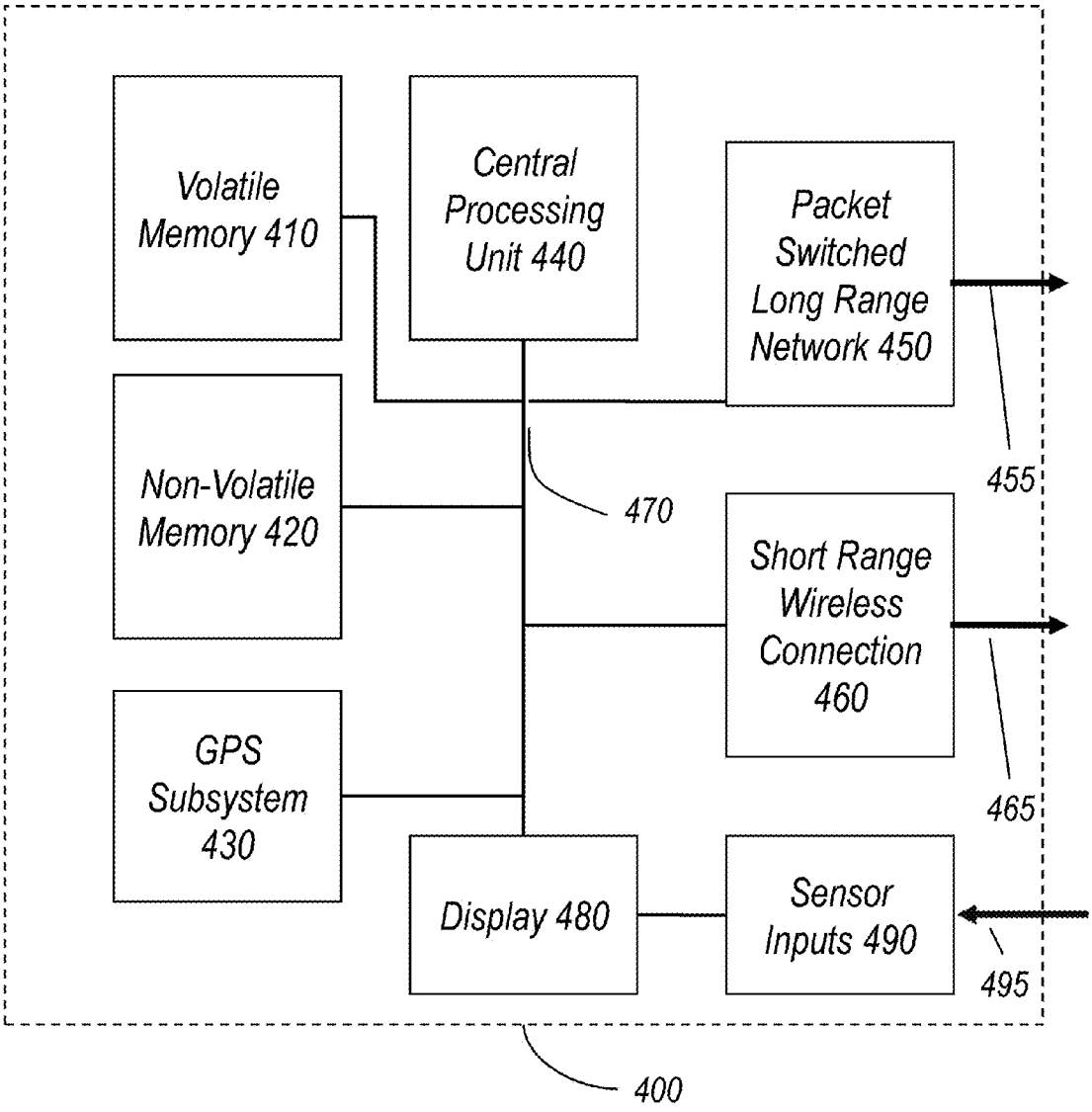
FIG. 4 shows a high level block diagram of a console device which may be used to carry out embodiments of the disclosed technology.

FIG. 4 shows a high level block diagram of a console device which may be used to carry out embodiments of the disclosed technology. Volatile memory 410 (such as random access memory) and non-volatile memory 420 (such as a solid state or magnetic storage device) store data, such as map data, instructions to be carried out by the central processing unit 440, graphics and text to be displayed, and so forth. Data from different subsystems is communicated via a bus system 470. The GPS subsystem 340 comprises a GPS receiver which receives signals from satellites, determines location based on triangulation of the received data, and outputs coordinates for further processing by the central processing unit 440 to display a current location. Such location information may be transferred by a packet-switched long range network interface 450 over a network 455, such as a radio communication network. A cellular data network, WiFi, WiMax, or other network may be utilized for this purpose. Via the long range network interface 450, location data is received related to the location of nearby people seeking taxi rides. In embodiments of the disclosed technology, the location data transmitted to the taxi consists only of location data of people seeking rides. No further information about potential riders is transmitted to the console at all, or in some embodiments, until it is verified that the rider is in the taxi. In some embodiments, a quantity of riders in a party to be picked up is sent, so the taxi driver may ensure that he/she can fit all the riders in his taxi. In other embodiments, the information is sent, but the console within the taxi only displays the location data and hides the rest of the received data.

The display 480 shows a map of the surrounding area and may include sensor inputs 490, such that when an area of the map is touched corresponding to where a location indicator is displayed (such as indicator 114 of FIG. 1, by way of example), this is recognized and the selection is transmitted over the bus system 470 and through the long range network 455. This causes other indicators to be removed from the display in this console, and the selected indicator to be removed in other consoles. Information is then transmitted, in embodiments of the disclosed technology, via the network 455 to the console 400, which may be used for verification. For example, a code may be transmitted to the console 400, and then the rider may only ride in the taxi if he provides this verification information. The verification data may be provided by way of a short range wireless connection 460 over network 465, such as a near field communication link, scanning of a code exhibited on a rider's handheld device, or the like. Another form of verification may be the location data. That is, unless the taxi driver is in the location represented by the selected indicator, the driver will not be able to proceed with billing (engaging the meter). In this manner, it is ensured that the rider picked up is the correct rider.

Figure 5:
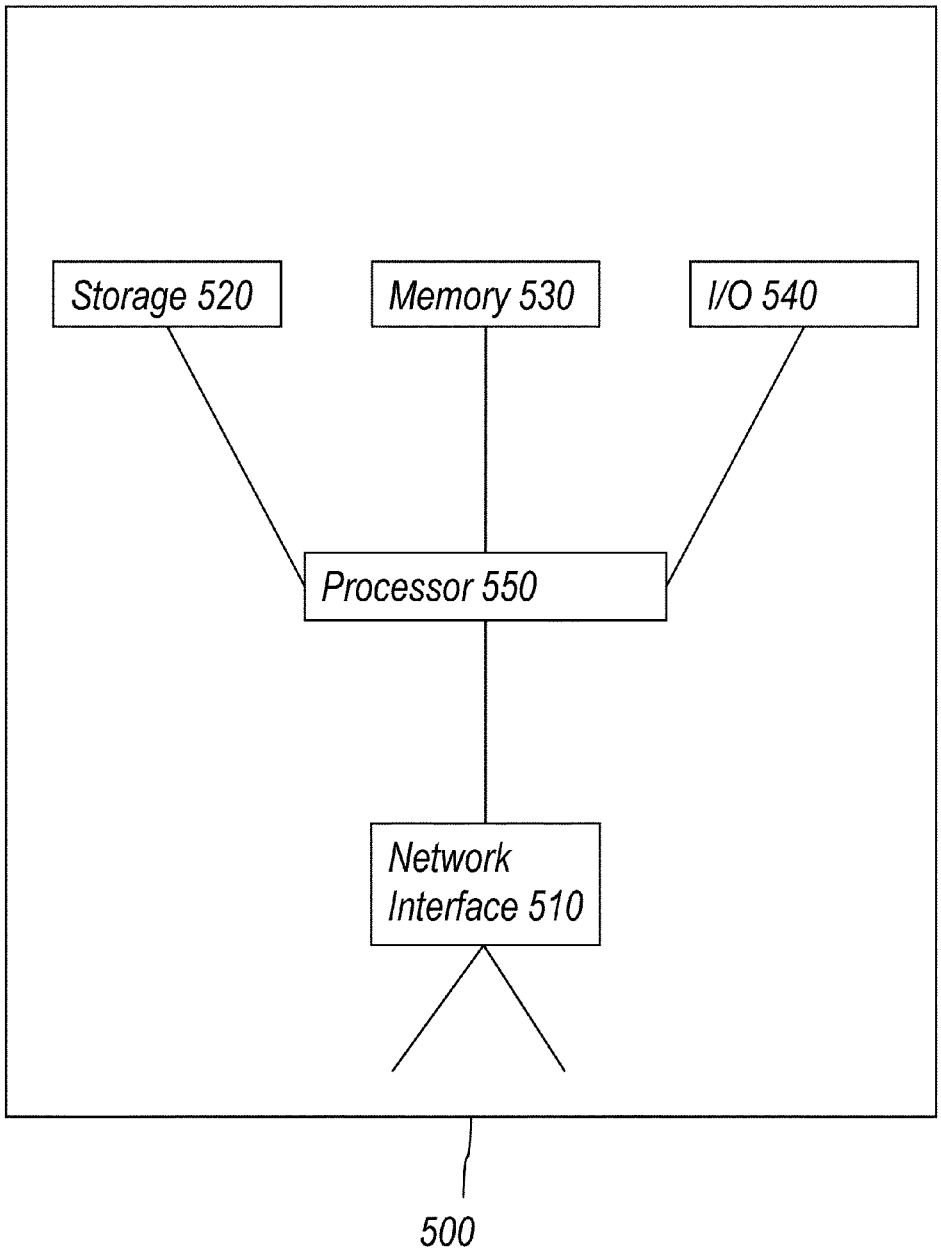
FIG. 5 shows a high-level block diagram of a device that may be used to carry out the disclosed technology.

FIG. 5 shows a high-level block diagram of a device that may be used to carry out the disclosed technology. Device 500 comprises a processor 550 that controls the overall operation of the computer by executing the device's program instructions which define such operation. The device's program instructions may be stored in a storage device 520 (e.g., magnetic disk, database) and loaded into memory 530 when execution of the console's program instructions is desired. Thus, the device's operation will be defined by the device's program instructions stored in memory 530 and/or storage 520, and the console will be controlled by processor 550 executing the console's program instructions. A device 500 also includes one or a plurality of input network interfaces for communicating with other devices via a network (e.g., the internet). A device 500 further includes an electrical input interface. A device 500 also includes one or more output network interfaces 510 for communicating with other devices. Device 500 also includes input/output 540 representing devices which allow for user interaction with a computer (e.g., display, keyboard, mouse, speakers, buttons, etc.). One skilled in the art will recognize that an implementation of an actual device will contain other components as well, and that FIG. 5 is a high level representation of some of the components of such a device for illustrative purposes. It should also be understood by one skilled in the art that the method and devices depicted in FIGS. 1 through 4 may be implemented on a device such as is shown in FIG. 5.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described hereinabove are also contemplated and within the scope of the invention.

The invention claimed is:

1. An in-taxi customer selection system, the system comprising:

in a plurality of taxis, a touch-screen display map of a surrounding location of each said taxi;

an indicator of at least one future rider desiring a taxi, exhibited anonymously on each said display map and lacking destination data;

sensors within said touch-screen display, wherein upon receiving a selection of an indicator on one of said display maps from a driver of one of said taxis, said indicator is removed from all other display maps and said driver is sent a confirmation of said selection.

2. The in-taxi customer selection system of claim 1, wherein said indicator is a plurality of indicators, each of at least one possible future rider desiring a taxi, all said indicators being identical.

3. The in-taxi customer selection system of claim 2, wherein said at least one future rider is notified as a result of a said sensor within said touch-screen display detecting a selection of a said indicator representative of said future rider.

4. The in-taxi customer selection system of claim 3, wherein a second detection of a selection made by said driver indicates that said formerly possible rider is now a rider inside of said car.

5. The in-taxi customer selection system of claim 4, wherein said driver is given instructions to proceed only if the first said selected indicator represented a location at which said taxi currently resides.

6. The in-taxi customer selection system of claim 5, wherein said currently residing taxi location is determined based on receiving data from a global positioning system satellite.

7. The in-taxi customer selection system of claim 6, wherein said instructions to proceed are given only if data from said rider is received and entered into a device comprising said display map.

8. The in-taxi customer selection system of claim 7, wherein said data is received in the form of a scannable ticket exhibited on a display.

9. The in-taxi customer selection system of claim 7, wherein at completion of a taxi ride by said rider, said payment is deducted from an account of said rider based on payment information provided before entering said taxi.

10. The in-taxi customer selection system of claim 7, wherein at least one indicator distinguishable from said indicator represents a location of another taxi.

11. A method of picking up a rider for a taxi ride comprising the steps of:

engaging a global positioning system to determine location;

viewing a street map showing said location;

viewing a plurality of indicators on said street map, each indicator anonymously representative of a person desiring to be a rider in a taxi and disappearing upon an indicator being selected by another;

using a processor to select a said indicator and driving to a location represented by said selected indicator on said street map;

picking up a rider and receiving data from said rider indicating that said rider is said person represented by said selected indicator.

12. The method of claim 11, wherein, upon said selecting, said other indicators are no longer displayed on said street map.

13. The method of claim 11, wherein said data is received by near field communication.

14. The method of claim 12, wherein said data is a confirmation code exhibited to a person carrying out said method by said rider and said taxi dispatch company.

15. The method of claim 12, wherein said method is carried out based on a request made for a taxi via a call to a telephone dispatcher.

16. A device in a first taxi, comprising:

satellite navigation capabilities;

a display comprising a map image of an area surrounding that of a present location determined by way of said satellite navigation capabilities;

bi-directional wireless communication configured to receive location data corresponding to locations of people desiring rides, wherein received data relating to said people desiring rides consists only of location data;

an interface capable of providing interaction capabilities with indicators overlaid on said map image, each indicator of said indicators placed on said map and corresponding to a location of a person of said people desiring rides;

wherein upon selection of a said indicator by way of said interface, non-selected indicators are removed from said display.

17. A second device comprising said satellite navigation capabilities, said display, said bi-directional wireless communication, and said interface of said device of clam 16, wherein said second device is in a second taxi; and upon selection of said indicator in said first taxi, said selected indicator is removed from said display of said second taxi.

18. The device of claim 16, wherein after selection of said indicator, via said bidirectional wireless communication, identifying information of a person receiving a ride is received and exhibited on said display to a driver of said taxi.

19. The device of claim 18, wherein said device authorizes said driver to charge said rider only if a current location detected via said satellite navigation capabilities is said location overlaid on said map of said selected indicator.

20. The device of claim 19, wherein said device further comprises a credit card reader.

* * * * *